United States Patent [19]

Weinberg

[11] 4,096,044

[45] * Jun. 20, 1978

[54] ELECTROCHEMICAL HYDROXYLATION OF CERTAIN AROMATIC COMPOUNDS

[75] Inventor: Norman Louis Weinberg, East Amherst, N.Y.

[73] Assignee: Hooker Chemicals & Plastics Corp., Niagara Falls, N.Y.

[ * ] Notice: The portion of the term of this patent subsequent to May 17, 1994, has been disclaimed.

[21] Appl. No.: 775,021

[22] Filed: Mar. 7, 1977

Related U.S. Application Data

[63] Continuation-in-part of Ser. No. 563,532, Mar. 31, 1975, Pat. No. 4,024,032.

[51] Int. Cl.[2] ..... C25B 3/02; C07C 29/00; C07C 39/00

[52] U.S. Cl. ..... 204/59 R; 204/72; 204/78

[58] Field of Search ..... 204/59 R, 72, 78

[56] References Cited

U.S. PATENT DOCUMENTS

| | | | |
|---|---|---|---|
| 3,252,876 | 5/1966 | Koehl | 204/59 R |
| 3,252,877 | 5/1966 | Koehl | 204/59 R |
| 3,448,021 | 6/1969 | Koehl | 204/72 |
| 4,011,145 | 3/1977 | Haufe et al. | 204/59 R |

*Primary Examiner*—F.C. Edmundson

*Attorney, Agent, or Firm*—Peter F. Casella; William J. Crossetta, Jr.; William R. Devereaux

[57] ABSTRACT

This invention provides a process for the electrochemical hydroxylation of aromatic compounds ring-substituted with an electron-withdrawing moiety and having a replaceable nuclear hydrogen. An aqueous liquid comprising the aromatic substrate and the anion of a strong carboxylic acid provided by a strong carboxylic acid or the salt of a strong carboxylic acid is electrolyzed to produce a nuclear-substituted hydroxy derivative of the aromatic substrate wherein the hydroxy group replaces a nuclear hydrogen.

22 Claims, No Drawings

ELECTROCHEMICAL HYDROXYLATION OF CERTAIN AROMATIC COMPOUNDS

This is a continuation-in-part of my copending application Ser. No. 563,532, filed Mar. 31, 1975, now U.S. Pat. No. 4,024,032.

FIELD OF THE INVENTION

This invention relates to the electrochemical synthesis of phenolic derivatives of substituted aromatic compounds. More particularly, this invention relates to a process for the preparation of useful phenols bearing electron-withdrawing moieties.

DESCRIPTION OF THE PRIOR ART

The search for efficient synthesis of phenolic compounds, for use, for example, in the manufacture of synthetic resins or pharmaceuticals, has resulted in a number of chemical methods utilized with varying degrees of success with regard to cost, yield, and purity of the desired aromatic alcohol. Well-known prior art processes for introducing the hydroxyl-group into an aromatic nucleus include allowing an aryl halide to react with sodium hydroxide at high temperature and pressure, allowing polynitro-aromatics to react with sodium hydroxide at elevated temperatures, allowing the decomposition of aryl diazonium salts in aqueous solution, and fusing aromatic sulfonates with sodium hydroxide at elevated temperatures.

However, the aforementioned routes are unsuitable alternatives if the sought-after phenol contains, for example, a strong electron-withdrawing substituent which decomposes in high temperature caustic alkali treatment.

Furthermore, the cost of the resulting phenol may be prohibitively high due to low final yield because of the number of steps involved in a reaction sequence.

In some instances, depending upon the elected synthetic route, it may be impossible to obtain any significant quantity of a desirable isomer of a phenol bearing an electron-withdrawing group because of the controlling mechanism.

One avenue of approach to this problem has been to synthesize an aromatic compound having both a substituent group sought-after in the final product and a group easily hydrolyzed to the corresponding isomeric hydroxyl group, and subsequently hydrolyzing said aromatic compound.

Electrochemical synthesis of acyloxy derivatives of certain substituted benzenes is known. The conversion of these acyloxy derivatives to the corresponding phenols is also known. U.S. Pat. No. 3,347,758 to Koehl, Jr. discloses the nuclear hydroxylation of benzene substituted with a group such as alkyl, mononuclear aryl, alkoxy, mononuclear aryloxy, acyloxy, or acylamido, with the preferred substituents being electron-donating alkyl groups. However, it is disclosed that benzene substituted with a group such as nitro, cyano, hydroxy, amino, chloro, bromo and the like is to be avoided. Controlled electrolysis of an anhydrous solution of an above-identified substituted benzene, e.g., toluene in acetic acid and acetic anhydride can yield a tolyl acetate according to the above-identified patent disclosure.

It is further disclosed that the alkanoic acids suitable for use in the process of the U.S. Pat. No. 3,347,758 to Koehl, Jr. are the C-2 to C-10 alkanoic acids. Preferred are the C-2 to C-6 acids such as acetic, propionic, butanoic, and pentanoic and their isomers, and the various hexanoic acids.

Another study relating to anodic acetoxylation of aromatic compounds appears in a paper presented by L. Eberson, *Journal of the American Chemical Society,* Vol. 89:18, pp. 4669–4677 (1967). Eberson discloses, (p. 4672) inter alia, that a substituted aromatic such as benzotrifluoride which contains the strongly electron-withdrawing trifluoromethyl ($F_3C$—) group does not undergo acetoxylation under specified reaction conditions comprising the use of glacial acetic acid 1.00 M in sodium acetate and 0.60 M benzotrifluoride, an anode potential of 2.4 volts vs. saturated calomel electrode, and an electrolyte temperature of 30° C. Eberson further discloses that since a substituent such as the trifluoromethyl group lowers the energy of the highest filled orbital of the benzotrifluoride molecule, it is therefore more difficult to remove electrons from this orbital by an anodic oxidation process. Consequently, before one can attain an anode potential high enough for oxidizing benzotrifluoride, discharge of acetate ion will take place and be the predominant electrode reaction. Pursuant to a study of the true isomer ratios in anodic acetoxylation, Eberson also discloses that the halobenzenes can be anodically acetoxylated to some extent under the above-identified conditions but no data with regard to current efficiency is provided.

U.S. Pat. No. 3,448,021 to Koehl, Jr. discloses a method for the electrochemical side-chain acyloxylation of substituted benzenes, such as p-chloro-toluene or p-cyano-toluene, comprising the use of a promoter such as cobalt acetate. U.S. Pat. Nos. 3,252,876 to Koehl, Jr. and 3,252,877 to Koehl, Jr. disclose the electrochemical synthesis of acyloxy derivatives of alkyl-substituted condensed ring aromatic compounds and unsubstituted condensed ring aromatic compounds respectively.

The electrochemical synthesis of the o-nitrophenyl ester of o-nitrobenzoic acid is disclosed in the earlier work of Schall, *Zeitschift fur Electrochemie,* 24, 154 (1918), where a solution of o-nitrobenzoic acid and acetic anhydride was oxidized at a platinum anode. Schall discloses that the actual equilibrium mixture contains potassium acetate and the mixed anhydride of o-nitrobenzoic acid and acetic acid. The electrolysis products isolated were o-nitrophenol, nitrobenzene, and the o-nitrophenyl ester of o-nitrobenzoic acid. The latter product is an acyloxylated derivative of a negatively substituted aromatic; however its formation involves electrochemical decarboxylation followed by substitution of the acyloxy group at the position of the lost carboxylic acid group. The Schall disclosure should be distinguished from the concept of the present invention which provides for the electrochemical hydroxylation of negatively substituted aromatics involving overall substitution by the hydroxy group of an aromatic hydrogen.

A review of the subject prior art is provided in the reference entitled *Technique of Electroorganic Synthesis,* John Wiley & Sons, 1974, Chapter IV, Part 3.

Disclosure of anodic oxidation of benzonitrile at a lead dioxide anode in aqueous sulfuric acid solution by Fichter et al. can be found in *Helv. Chim. Acta,* 4, 928 (1921) with the products being 1,2,4-trihydroxybenzene and 2,5-dihydroxybenzonitrile. No disclosure of a strong carboxylic acid medium can be found in Fichter et al., unlike the present invention, which prefers no strong mineral acid, but instead, a strong carboxylic acid medium.

Disclosure of anodic oxidation of a reactant containing both a strongly electron-withdrawing moiety and a carboxyl group can be found in Kenner et al., *Tetrahedron* 1, 259 (1957). Formation of an aromatic lactone substituted with a strongly electron-withdrawing group results, and hydrolysis can be expected to yield a phenol similarly substituted. However, Kenner et al. can produce only a limited number of substituted phenols, unlike the present invention, which can be used to produce a wide range of substituted phenols. Moreover, the Kenner et al. reference directs attention exclusively to formation of the lactone, thereby precluding use of separate reactants respectively carrying the aromatic nucleus and strong carboxylic acid group. Furthermore, the diphenyl-2 carboxylic acids specified by Kenner et al. would be expected to have a $pK_a$ ($H_2O$) at 25° C greater than 3. It is the surprising and unexpected result of the present invention that direct hydroxylation of negatively substituted aromatics can be produced by electrochemical means for reactants which employ an anion of a strong carboxylic acid with a $pK_a$ ($H_2O$) at 25° C. value of less than about 3. Accordingly, the present invention teaches away from the formation of the products specified by Kenner et al.

Eberson and Helgee, *Chemica Scripta*, 5, 47–48 (1974) have described a useful method for aromatic cyanation and acyloxylation in aqueous media. The method utilizes an emulsion consisting of the aromatic, methylene chloride, a phase transfer agent, a quaternary ammonium ion, and an aqueous solution of the nucleophile. One important advantage of such a system is the high conductivity achievable compared with anhydrous systems. The phase transfer agent ensures that the electrode process takes place in the organic phase.

SUMMARY OF THE INVENTION

It is an object of this invention to provide a novel process for the synthesis of phenols containing a ring-substituted electron-withdrawing moiety.

It is another object of this invention to provide a novel process for the nuclear hydroxylation of an aromatic compound containing a ring-substituted electron-withdrawing moiety and a replaceable nuclear hydrogen.

Another object of the present invention is to provide a medium which exhibits greater specific conductivity than results from some non-aqueous organic solutions commercially used for electrochemical synthesis. This can result in significant savings in power consumption.

Another object of the invention is to reduce capital expenditures required to provide a suitable solvent medium.

A further object of the invention is to obviate the necessity for a separate hydrolysis step, which could be necessary for a synthesis of the phenols of the present invention according to other (for example, anhydrous) syntheses. If, for example, an intermediate ester must first be formed, hydrolysis of the ester requires the additional step. Such an ester is formed in certain prior art syntheses of phenols in non-aqueous reaction media.

A further object of the invention is to simplify commercial production of the phenols of the present invention where such processes require maintenance of strictly anhydrous conditions in commercial processes for their manufacture.

Other objects of this invention will be readily apparent from a consideration of the specification and the claims to this invention.

In accordance with the aforementioned objects this invention provides for the introduction of a hydroxyl group into the nucleus of an aromatic ring containing at least one ring-substituted electron-withdrawing moiety and a replaceable nuclear hydrogen by a process comprising a reactant containing said nucleus and a reactant containing an anion of a strong carboxylic acid. Substitution of a hydroxy group results wherein a nuclear hydrogen is replaced. More particularly, this invention provides for the introduction of a hydroxy group into the nucleus of a molecular aromatic compound containing at least one ring-substituted electron-withdrawing moiety and a replaceable nuclear hydrogen by a process comprising electrolyzing an aqueous mixture comprising said aromatic compound and an anion of a strong carboxylic acid. In the latter instance, the reaction medium contains preferably both a strong carboxylic acid and an alkali metal, alkaline earth metal, quaternary ammonium, or quaternary phosphonium salt of a strong carboxylic acid.

The term "aromatic substrate" refers to an aromatic nucleus, ring-substituted with at least one electron-withdrawing moiety, and having a replaceable nuclear hydrogen, which exists as a molecular compound or as the cationic component of an organic salt.

The term "substrate," "nucleus," and "anion" encompass both the description of chemical entities and their use in the aggregate.

The term "electron-withdrawing moiety" encompasses substituents, such as trifluoromethyl, nitro, or carboxylic ester, which are strong electron-withdrawing groups, and electron-withdrawing aromatic radicals such as chloride. Such moieties, when bonded to an aromatic ring, heretofore have rendered anodic nuclear oxidation of the respective aromatic substrates difficult if not impossible to achieve. Such moieties are also referred to in the art as electronegative substituents.

One having skill in the art will recognize that while theoretical considerations concerning the relative contributions of resonance and inductive effects of the substituent moieties upon the electron distribution of the aromatic substrate molecules may prove of value in elucidating some of the phenomena which result from the practice of this invention, an understanding or discussion of such theoretical considerations is not necessary for the successful practice of this invention.

By "strong carboxylic acid" is meant a carboxylic acid having a $pK_a$ ($H_2O$) value at 25° C of less than about 3. Generally, such acids have an electron-withdrawing moiety bonded to the carboxyl carbon atom. A class of carboxylic acids having such $pK_a$'s are those which possess an electron-withdrawing atom or group in the α-position, that is, bonded to the carbon atom adjacent to the carboxyl carbon atom. Examples of such acids are α-halogen acetic acids including chloroacetic acid ($ClCH_2CO_2H$) and trifluoroacetic acid ($F_3CCO_2H$), cyanoacetic acid ($NCCH_2CO_2H$), and nitroacetic acid ($O_2NCH_2CO_2H$).

In general, it may be stated that as the strength of the electron-withdrawing influence of the aromatic substituent on the aromatic nucleus increases, correspondingly stronger carboxylic acids and salts are required, i.e., acids or salts of acids having smaller $pK_a$ ($H_2O$) values, in order to achieve good product yields and, furthermore, a $pK_a$ ($H_2O$) at 25° C value of about 3 represents a practical and not absolute maximum value for an acid suitable for use in this invention.

DETAILED DESCRIPTION OF THE INVENTION

In order to more fully describe the subject invention, a possible reaction mechanism for anodic hydroxylation of aromatics is depicted by the following reactions. It is to be understood, however, that, while such reactions may be helpful in understanding on a theoretical basis one suggested manner in which the present invention proceeds, such understanding is in no way necessary for successful practice of the invention, nor is the invention intended to be limited in any way by such suggestions of a possible reaction mechanism.

FIG. I

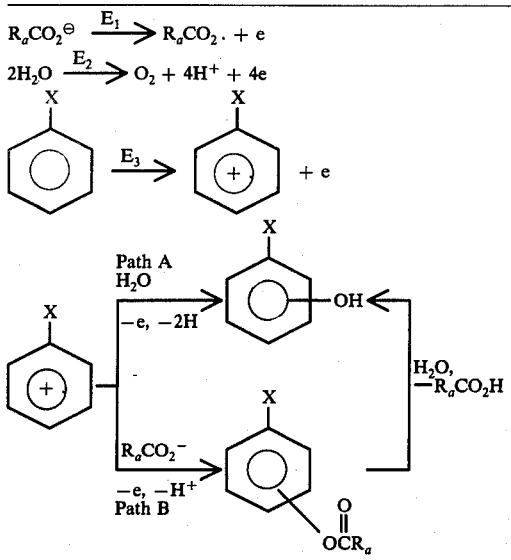

where $x$ represents a substituent, $R_aCO_2^{\ominus}$ represents a carboxylic acid anion, $E_1$ represents the discharge potential of the carboxylate, $E_2$ represents the discharge potential of water, and $E_3$ represents the discharge potential of the aromatic. It would be expected from published literature values that water discharge would be the most facile process and that little or no discharge of the carboxylate or the negatively substituted aromatic should occur if it is solely the potentials $E_1$, $E_2$, and $E_3$ which govern the processes likely to occur. However, it is also known that adsorption of various species can play an important role in determining which processes will occur. Thus, the first electron-transfer step of the Kolbe reaction is known to be expressed by Reaction 1. In spite of the fact that $E_2$ is very often less than $E_1$ (and hence water electrolysis should predominate), the Kolbe reaction can be carried out quite successfully in aqueous media. Apparently, preferential adsorption of the carboxylate on the electrode occurs, excluding the adsorption of water. If the discharge potential of the carboxylate ($E_1$) is reached, Reaction 1 is preferred, since it is that species which is on the electrode which will be discharged.

A mechanism which may explain the success of this invention is the following. The negatively substituted aromatic is adsorbed on the anode in competition with the carboxylate. Both species now help to exclude the adsorption of water on the anode. The aromatic, providing the discharge potential $E_3$ is reached, undergoes anodic oxidation (Reaction 3) and then reacts with the nucleophiles present, that is, either water (Path A) or carboxylate (Path B). Reaction 4 shows that the corresponding phenol of the negatively substituted aromatic is formed by Path A or Path B. For purposes of the present invention it is unimportant which of these paths predominate, nor is it important whether the mechanism as described by the Reactions 1 to 4 truly express the product forming processes.

In accordance with this invention, it has been found that the hydroxylation of an aromatic nucleus, containing a strong electron-withdrawing substituent such as the trifluoromethyl group, is accomplished by electrolyzing the aromatic compound in the presence of $R_aCO_2^{\ominus}$ described above where $R_aCO_2^{\ominus}$ represents the carboxylate anion of acids having a $pK_a$ value of less than about 3 and preferably less than 2. Exemplary of such carboxylic acids are the following: mono-, di-, and trichloroacetic acid, mono-, di-, and tribromoacetic acid, mono-, di-, and trifluoroacetic acid, α-chloro and α,α-difluorobutyric acid, α-chloro, α,α-difluoroacetic acid, and related acids.

Also feasible for use in this invention are acids such as cyanoacetic, nitroacetic, o-chlorobenzoic, o-bromobenzoic, o-nitrobenzoic, 2,4-dinitrobenzoic, maleic, malonic, phenylmalonic, oxalic, o-phthalic, salicylic, and fumaric acid and related acids. Mixtures of these and equivalent acids are also contemplated for use in this invention.

Chloroacetic acid has a $pK_a$ ($H_2O$) at 25° C of 2.85 whereas the same $pK_a$ ($H_2O$) value for acetic acid is 4.76. The $pK_a$ ($H_2O$) values for some of the acids feasible for use in this invention are provided in Table I or can be readily calculated from the generally accepted dissociation constants. Table II provides $pK_a$'s for acids outside of the scope of this invention for purposes of comparison. Tables I and II values can be found in *Handbook of Chemistry and Physics,* R. C. Wearth, ed., 49th ed., Chemical Rubber Publishing Co., Cleveland, 1968, pp. D-90 to D-91.

TABLE I

| Carboxylic Acid | $K_a(H_2O)$ at 25° C | $pK_a(H_2O)$ at 25° C |
|---|---|---|
| chloroacetic | $1.4 \times 10^{-3}$ | 2.85 |
| dichloroacetic | $3.32 \times 10^{-2}$ | 1.48 |
| trichloroacetic | $2 \times 10^{-1}$ | 0.70 |
| bromoacetic | $2.05 \times 10^{-3}$ | 2.69 |
| α-chloropropionic | $1.47 \times 10^{-3}$ | 2.83 |
| α-chlorobutyric | $1.39 \times 10^{-3}$ | 2.86 |
| cyanoacetic | $3.65 \times 10^{-3}$ | 2.45 |
| o-nitrobenzoic | $6.95 \times 10^{-3}$(18° C) | 2.16(18° C) |
| trifluoroacetic | * | 0 |

*generally accepted as completely dissociated in aqueous solution - having a $pK_a(H_2O)$ at 25° C value of zero.

TABLE II

| Carboxylic Acid | $K_a(H_2O)$ at 25° C | $pK_a(H_2O)$ at 25° C |
|---|---|---|
| acetic | $1.76 \times 10^{-5}$ | 4.75 |
| propionic | $1.34 \times 10^{-5}$ | 4.87 |
| β-chloropropionic | $1.04 \times 10^{-4}$ | 3.98 |
| n-butyric | $1.54 \times 10^{-5}$(20° C) | 4.81(20° C) |
| β-chlorobutyric | $8.9 \times 10^{-5}$ | 4.05 |
| n-valeric | $1.5 \times 10^{-5}$ | 4.82(18° C) |
| vinylacetic | $4.57 \times 10^{-5}$ | 4.34 |
| benzoic | $6.46 \times 10^{-5}$ | 4.19 |
| phenylacetic | 5.2 × (18° C) | 4.28(18° C) |

One having skill in this art will recognize that the acidity of a given carboxylic acid is enhanced by the inductive or electron attracting character of the group adjacent the carboxyl group and, accordingly, the acidity varies with the electronegativity of the moiety adjacent the carboxyl group.

The salt of the carboxylic acid can be present in both homogeneous and heterogeneous electrolyte systems. The homogeneous systems consist of water, a cosolvent to dissolve all of the components sufficiently, and the salt. The heterogeneous electrolyte system consists of an emulsion (such as described by Eberson and Helgee, supra), composed of a conductive aqueous phase and a conductive non-aqueous phase. The non-aqueous phase of the heterogeneous system generally contains the negatively substituted aromatic and a water-insoluble salt. The aqueous phase of the heterogeneous system generally contains the strong carboxylic acid and its water-soluble salt. It will be recognized that there are instances wherein the aromatic may preferentially dissolve in the aqueous phase and the carboxylic acid, as well as its salt, will distribute itself substantially in both the aqueous and non-aqueous phases of a heterogeneous system.

A salt of the carboxylic acid may be present in the aqueous phase of a heterogeneous electrolyte system, as well as in the non-aqueous phase, and can be the salt of the same or a different strong carboxylic acid. In a homogeneous electrolyte system, the system preferably contains a salt of a strong carboxylic acid. Suitably the cation of the salt can be selected from the group of alkali metals, alkaline earth metals, quaternary ammoniums, phosphoniums and sulfoniums, crown ether salts, and the like. Typically, the cations may be sodium, lithium, rubidium, cesium, magnesium, calcium, barium, strontium, tetramethylammonium, tetraethylammonium, crown ether sodium, and the like. Because of their solubility, availability and effectiveness, the sodium and potassium salts are preferred for homogeneous systems and the aqueous phase of heterogeneous systems. Other salts suitable for use in this invention may be formed in situ by combining a suitable acid with a tertiary amine or an aromatic amine such as pyridine to produce, for example, pyridinium trifluoroacetate. One function of the salts if to increase the conductivity of the homogeneous and the heterogeneous media.

The aromatic compounds containing at least one ring-substituted electron-withdrawing moiety and having a replaceable nuclear hydrogen can be either monocyclic or polycyclic condensed aromatic hydrocarbons, such as benzenes, naphthalenes, anthracenes, and the like, or heterocycles. Representative of the aromatic heterocycles are those containing oxygen, nitrogen, or sulfur as the heteroatom and include the furans, benzofurans, pyrroles, pyridines, pyridazines, pyrazines, quinolines, isoquinolines, thiophenes, and the like. The substrate aromatic compound can also contain electron-donating substituents such as an alkyl group, for example, methyl tertiary butyl, n-hexyl, and the like, or other substituents which decrease the oxidation potential of the aromatic compound. One having skill in this art will recognize that with regard to considerations concerning the hydroxylation susceptibility of a polycyclic nucleus such as, for example, naphthalene substituted with an electron-withdrawing moiety, competing electron-withdrawing and electron-donating effects are present at the ring bearing the electron-withdrawing moiety due to the electron-donating influence of the adjacent aromatic portion of the molecule.

Representative of the electron-withdrawing substitutents ring bonded to an aromatic nucleus are the following moieties: nitro ($-NO_2$), nitroso ($-NO$), cyano ($-CN$), carboxyl ($-CO_2H$), carboxylic ester ($-CO_2R$), carboxylic acid anhydride ($-CO_2COR$), aldehydic carbonyl ($-CHO$), keto ($-COR$), amido ($-CONH_2$), substituted amido ($-CON(R)_2$), sulfoxide ($-SOR$), sulfone ($-SO_2R$), sulfonate ($-SO_3R$), sulfonium ($-S^{\oplus}(R)_2$), azo ($-NNR$), azoxy ($-NONR$ where the oxygen atom is bonded to either N atom), fluoro ($-F$), chloro ($-Cl$), bromo ($-Br$), phosphine oxides ($-P(O)(R)_2$), ($-^{\oplus}PH(R)_2$), ($-^{\oplus}PH_2R$), quaternary ammoniums ($-^{\oplus}N(R)_3$), ($-^{\oplus}NH(R)_2$), ($-^{\oplus}NH_2R$), iodoso ($-IO$), substituted iodoso ($-IX_2$, $-I(O_2CR_2)$ such as iodobenzene dichloride, iodosobenzenediacetate, or iodosobenzene-trifluoroacetate, iodoxy ($-IO_2$), chloronium ($-^{\oplus}ClR'$), bromonium ($^{\oplus}BrR'-$) and iodonium ($I^{\oplus}R'-$) where R' is aryl, where X is halide and where R represents a moiety bonded to the electron-withdrawing portion of the molecule adjacent the aromatic ring. Representative but not limitative of such R moieties are the straight or branched chain lower alkyls having from one to eight carbon atoms, straight or branched chain higher alkyls, aryls such as phenyl, napthyl, and the like, heterocycles, or substituted alkyls, aryl and heterocycles, that is, those containing the same substituents as represented above or other chemical moieties desired.

Further representatives of the electron-withdrawing substituents ring-bonded to an aromatic nucleus are alkyls bearing electron-withdrawing moieties in the alpha position. The electron-withdrawing moieties can be selected from the group represented above. Examples of such $\alpha$-electron-withdrawing moiety alkyls are $\alpha$-cyanoalkyl, e.g., ($-CH_2CN$), $\alpha$-nitroalkyl, e.g., ($CH_2NO_2$), and the stable $\alpha$-haloalkyls which are relatively stable to hydrolysis, such as the saturated fluorocarbon ($-CF_2CF_2R$), where R is as defined above, difluoromethyl ($-CHF_2$), and the perhaloalkyls such as trifluoromethyl ($-CF_3$).

One skilled in the art will recognize that the electron-withdrawing influence of the $\alpha$-electron-withdrawing moiety alkyls is exerted upon the aromatic nucleus through the alkyl carbon atoms bonded to the ring.

A further class of nuclear-bonded electron-withdrawing substituents is the halogenated ethylidenes ($-CX'=C(X'')_2$) where X' can be hydrogen, halogen, or trihalomethyl and X'' can be halogen or trihalomethyl. Representative of such halogenated ethylidenes are groups such as $\beta,\beta$-difluorovinyl ($-CH=CF_2$), $\alpha$-trifluoromethyl $\beta,\beta$-difluorovinyl ($-C(CF_3)=CF_2$).

The description above of electron-withdrawing substitutents ring-bonded to an aromatic nucleus is intended to be illustrative of such moieties and not a limitation thereof, as equivalents will be readily suggested upon a reading of this invention disclosure. On having skill in the electrochemical art will recognize that competing chemical or electrochemical reactions of the substituent groups may occur along with the nuclear hydroxylation reaction.

It is to be recognized that when this specification refers to an aromatic nucleus ring-substituted with quaternary ammonium quaternary phosphonium, sulfonium, chloronium, bromonium, or iodonium moieties, the same terminology, e.g., quaternary ammonium, can apply to the cationic component of the ring-substituted aromatic organic salt as well as to the salt of the carboxylic acid or acids which may be present in the heterogeneous or homogeneous electrolyte system. In such instances, the cationic component contains the aromatic nucleus which is hydroxylated by a carboxylic acid anion according to the process of this invention.

The aqueous reaction mixture may contain soluble and insoluble cosolvents. Among the soluble cosolvents are the lower carboxylic acids, preferably alkanoic acids containing from 1 to about 5 carbon atoms, such an acetic acid, as well as acetonitrile, hydrogen fluoride and nitromethane. Among the insoluble cosolvents are methylene chloride, ethylene dichloride higher liquid carboxylic acids preferably alkanoic acids containing from 5 carbon atoms to about 15 carbon atoms, and liquid aromatic compounds that have a very high anodic discharge potential, such as nitrobenzene and benzotrifluoride.

The solution is subjected to agitation and electrolyzed at ambient temperature using a conventional anode. High speed stirring may be required to emulsify a heterogeneous system. Preferably, higher temperatures are employed, by which means the solution viscosity is lowered and hence the conductivity increased. Upon completion of the electrolysis reaction, the resulting system is extracted with a suitable organic solvent such as chloroform to separate the product phenol. Following the separation, the solvent extract, containing the hydroxylated aromatic products, is dried by conventional methods, and the extraction solvent is removed by conventional means such as flash evaporation.

In accordance with one embodiment of this invention electrolytic hydroxylation can be conducted in an aqueous solution of strong carboxylic acid. However, in this embodiment, it is preferred to provide also an alkali metal, alkaline earth metal, or quaternary ammonium salt of a strong carboxylic acid, and preferably the salt of the same carboxylic acid used as the acid solvent, in the reaction system since electrochemical polymerization of the aromatic substrate may occur in its absence or the desired hydroxylated product may be formed in low yield due to the low concentration of carboxylic acid anions. Provision of the salt corresponding to the solvent acid facilities purification of the reaction mass and resolution of the specific compound desired. As previously mentioned, provision of a salt also facilitates the reaction by increasing the conductivity of the electrolytic medium. Other salts useful in the practice of the invention as supporting electrolytes include p-toluenesulfonate, trifluoromethylsulfonate, perchlorates, tetrafluoroborates, and hexafluorophosphates.

The concentration of the carboxylate salt or additional supporting electrolytes in aqueous solutions may range as high as about 10 molar. Beneficial results can be obtained with carboxylate salt concentrations in the range of from about 0.1 to about 1.5 molar and this concentration is preferred. The concentration of the phase transfer agent in the organic phase of heterogeneous systems can range as high as 5 molar, but suitable results can be obtained at concentration of 0.001 to 0.1 molar. High concentrations do not contribute to appreciably better yields of reaction product.

The concentration of the aromatic substrate substituted with the electron-withdrawing group is suitably from about 0.01 molar to about 10 molar, and preferably from about 0.02 to about 5 molar. However, in some instances the aromatic substrate itself, for example, nitrobenzene, may be sufficiently conducting in the presence of a suitable supporting electrolyte, for example, a quaternary ammonium salt of trifluoroacetic acid and water which is, per se, the hydroxylating agent.

The hydroxylation process of this invention can be conducted at temperatures ranging from slightly above the freezing point of the reaction solution to temperatures attained at reflux conditions. Conveniently, temperatures from about 0° Centigrade to about 50° Centigrade are utilized with higher temperatures decreasing solution viscosity and hence increasing conductivity. Pressure conditions are not critical; thus, superatmospheric, subatmospheric, or atmospheric pressures can be used successfully.

Static or flow cells can be utilized in the practice of this invention and include the capillary gap cell, batch cell, plate and frame flow cell, or fluidized bed cell techniques. Flow cells are preferred to help avoid further oxidation of the product. One skilled in the art will appreciate that the selection of cell design such as one providing for separation of anode and cathode compartments by means of an ion-exchange membrane, may be contingent upon the ease of reduction of the aromatic substrate selected or the resulting hydroxylating product. Generally, the electrodes can be of the rotated or stationary type and may be constructed of any conductive material which is inert to the reagents contacting said electrodes and will not be passivated. Examples of such electrode materials as anodes are carbon, lead, lead dioxide, noble metals and their oxides, as well as noble metal or noble metal oxides as a coating on a valve metal such as titanium. The latter mentioned electrode materials are materials of choice in conventional electrodes known as "dimensionally stable anodes." As cathodes one can utilize, for example, iron, steel, carbon, platinum, lead or copper.

Electrode current densities for use in the hydroxylation process of this invention are generally provided in the range of from about 0.001 to about 10 amperes per square centimeter of anode surface, and preferably from 0.01 to 1.0 amperes per square centimeter. The potential of the anode should be provided at a value of at least +2.0 volts to about +5.0 volts, as measured against the saturated calomel electrode (aqueous) and preferably from about +2.5 to +5 volts. Optimally, the anode potential, as measured against the saturated calomel electrode should be in the range of 3 to 5 volts. One skilled in the art will recognize that the aforementioned range will depend upon variables such as the aromatic substrate selected as well as the chemical and electrochemical variables, a discussion of which is found in an article entitled "an Organic Chemist's Approach to Electroorganic Synthesis," *Chem. Tech.*, March 1974, (pp. 184–189).

Alternating current, preferably less than 60 cycles/sec. can be used, providing the starting material or product is not reduced at the potential of the current reversal. A single compartment cell is used with alternating current. Noble metal electrodes or those with low hydrogen overpotential in protic media are preferred as on the cathode swing $H_2$ evolution will then be more likely to occur than reduction of the starting material or the hydroxylated product.

The use of direct current is the more usual manner of practicing of this invention; however, pulsed direct current is found beneficial for reasons including the cleansing of the electrode surface and providing time for slower chemical reactions to occur.

Diaphragms or membranes may be used to separate the anode and cathode compartment of the electrolysis cell, although such use is not a requirement in protic media, especially if the cathode material has a low hydrogen overpotential.

The term "medium" as used herein in the specification and claims is understood to encompass both heterogeneous and homogeneous liquid systems.

The process of this invention will be illustrated by the following examples.

EXAMPLE I

The electrochemical hydroxylation of benzotrifluoride (0.072 M) was carried out in a one-compartment glass cell, 300 ml. in volume, and kept at room temperature. The electrolyte mixture was magnetically stirred and consisted of trifluoroacetic acid in 1 M sodium trifluoroacetate and water. The anode was platinum foil (10 $cm^2$) and the cathode a carbon rod (¼ × 2 inches). Electrolyses were conducted using a DC power supply and digital multimeter.

| % $H_2O$ Present | Controlled Current (Amps) | Isomer Distribution* o- | m- | p- | Current Efficiency Phenols (%) |
|---|---|---|---|---|---|
| 10 | 0.2 | 5 | 73 | 22 | 35 |
| 20 | 0.4 | 5 | 74 | 21 | 24 |
| 40 | 0.2 | 4 | 75 | 21 | 7 |
| 50 | 0.4 | — | — | — | 0 |

*GC analysis was carried out with a Perkin-Elmer Model 3920 Gas Chromatograph using a 5% NPGS/Chromosorb W column.

Mass spectroscopic analysis on the crude phenol product indicated the presence of dihydroxybenzotrifluorides, and possible dimers of benzotrifluoride.

EXAMPLE 2

In a similar electrolysis to that described in Example 1, nitrobenzene (0.06 M) was electrolyzed in an aqueous solution of trifluoroacetic acid with 1 M sodium trifluoroacetate. The cell was a two compartment glass vessel with a fritted glass separator. With 10% water present a current efficiency of 22% was achieved for phenol formation.

EXAMPLE 3

In an identical electrolysis experiment to that described in Example 2 except for the presence of 20% of water in the electrolyte, a current efficiency of 26% was obtained for phenol formation.

EXAMPLE 4

An emulsion was prepared by mechanically stirring a mixture of benzotrifluoride (0.07 M), 100 ml. methylene chloride, 2.4 M sodium trifluoroacetate, 100 ml. distilled water, 0.05 M trifluoroacetic acid and 0.02 M tetra-n-butylammonium hydrogen sulfate. Electrolysis of this emulsion was performed in a one-compartment cell with electrodes described earlier (Example 1) and a current of 1 amp. After the electrolysis the methylene chloride layer was examined by gas chromatography. All three isomers of hydroxybenzotrifluoride were present.

EXAMPLES 5 AND 6

The importance of the presence of the salt of a strong carboxylic acid in the electrolyte was examined.

EXAMPLE 5

Electrolysis of a mixture of sodium tetrafluoroborate (1 M), benzotrifluoride, 100 ml. of trifluoroacetic acid and 50 ml. of distilled water was conducted as in Example 1. No phenolic products were found after work-up.

EXAMPLE 6

Electrolysis of an emulsion of sodium acetate (0.02 M), 100 ml. methylene chloride, 100 ml. distilled water, 0.05 M acetic acid, and 0.02 M tetra-n-butyl-ammonium hydrogen sulfate was carried out as in Example 4. No phenolic products were found after work-up.

The references to various embodiments of the invention disclosed herein are intended to illustrate the invention and are not intended to limit it. One skilled in the art will appreciate that various changes can be made, and equivalents substituted, in the process of this invention without departing from its spirit and scope. Such modifications are considered to be within the scope of this invention.

Temperatures are intended to be expressed in degrees centigrade unless otherwise specified. All parts and proportions are by weight, unless otherwise specified.

In view of the foregoing disclosure I claim:

1. An electrochemical hydroxylation process comprising electrolyzing an aqueous liquid comprising
(a) at least one soluble cosolvent;
(b) an aromatic substrate comprising an aromatic nucleus ring-substituted with at least one electron-withdrawing moiety and having at least one replaceable nucleus hydrogen; and
(c) an anion of a strong carboxylic acid having a $pK_a$ ($H_2O$) at 25° C. value of less than about 3
to effect nuclear hydroxylation of said aromatic substrate wherein a hydroxy group replaces said hydrogen.

2. A process according to claim 1 wherein said cosolvent is selected from the group consisting of acetonitrile, nitromethane, lower carboxylic acids, or mixtures thereof.

3. A process according to claim 2 wherein said carboxylic acids comprise substituted alkanoic acids containing from one to about five carbon atoms.

4. A process according to claim 1 wherein said cosolvent is selected from the group consisting of methylene chloride, ethylene dichloride, and higher liquid carboxylic acid, and liquid aromatic compounds having a high anodic discharge potential.

5. A process according to claim 4 wherein said liquid aromatic compounds are selected from the group consisting of nitrobenzene and benzotrifluoride.

6. A process according to claim 1 wherein said aromatic substrate is selected from the group consisting of aromatic hydrocarbons and aromatic heterocycles.

7. A process according to claim 1 wherein said cosolvent is hydrogen fluoride.

8. A process according to claim 1 wherein said cosolvent is a mixture of hydrogen fluoride and lower carboxylic acids.

9. An electrochemical hydroxylation process comprising electrolyzing a an aqueous homogeneous liquid comprising
(a) a molecular aromatic substrate ring-substituted with at least one electron-withdrawing moiety and having at least one replaceable nuclear hydrogen,
(b) a strong carboxylic acid having a $pK_a(H_2O)$ at 25° C. value of less than about 3, and
(c) a salt of said carboxylic acid
to effect nuclear hydroxylation of said aromatic compound, wherein a hydroxyl group replaces said hydrogen.

10. A process according to claim 9 wherein said strong carboxylic acid has a $pK_a$ ($H_2O$) at 25° C. value of less than 2.

11. A process according to claim 10 wherein said $pK_a(H_2O)$ at 25° C. value is less than 1.

12. An electrochemical hydroxylation process comprising electrolyzing aqueous homogeneous liquid consisting essentially of (a) a molecular aromatic substrate ring-substituted with at least one electron-withdrawing moiety, and having at least one replaceable nuclear hydrogen, (b) a strong carboxylic acid having a $pK_a(H_2O)$ at 25° C. value of about 3, and (c) a salt of said carboxylic acid to effect nuclear hydroxylation of said aromatic compound, wherein a hydroxy group replaces said hydrogen.

13. A process according to claim 12 wherein said strong carboxylic acid has a $pK_a(H_2O)$ at 25° C. value of less than 2.

14. A process according to claim 13 wherein said strong carboxylic acid has a $pK_a(H_2O)$ at 25° C. value of less than 1.

15. An electrochemical hydroxylation process comprising electrolyzing a solution medium comprising (a) a molecular aromatic substrate ring-substituted with at least one electron-withdrawing moiety and having at least one replaceable nuclear hydrogen, wherein said moiety is selected from the group consisting of α-haloalkyl, α,α,α-trihaloalkyl, halogenated ethylidene, nitro, nitroso, cyano, carboxyl, carboxylic ester, carboxylic acid anhydride, aldehydic carbonyl, keto, amido, substituted amido, sulfonium, sulfoxide, sulfone, sulfonate, azo, azoxy, fluoro, chloro, bromo, phosphine oxide, quaternary phosphonium, quaternary ammonium, iodoso, substituted iodoso, iodoxy, chloronium, bromonium and iodonium, and (b) an anion of a strong carboxylic acid having a $pK_a(H_2O)$ at 25° C. value of less than about 3, to effect nuclear hydroxylation of said aromatic compound, wherein a hydroxyl group replaces said hydrogen.

16. A process according to claim 15 wherein said aromatic substrate is an aromatic hydrocarbon ring-substituted with at least one electron-withdrawing moiety and having at least one replaceable nuclear hydrogen, said moiety being selected from the group consisting of trifluoromethyl, aldehydic carbonyl, and carboxylic ester substituted aromatic hydrocarbons.

17. A process according to claim 16 wherein said aromatic hydrocarbon is benzotrifluoride.

18. A process according to claim 16 wherein said aromatic hydrocarbon is selected from the group consisting of methyl benzoate and ethyl benzoate.

19. A process according to claim 16 wherein said aromatic hydrocarbon is benzaldehyde.

20. A process according to claim 15 wherein said strong carboxylic acid has a $pK_a(H_2O)$ at 25° C. value of less than 2.

21. A process according to claim 20 wherein said $pK_a(H_2O)$ at 25° C. is less than 1.

22. An electrochemical hydroxylation process comprising electrolyzing an aqueous medium consisting essentially of a solution of a strong carboxylic acid, and a salt of an organic cation selected from the group consisting of a quaternary ammonium, quaternary phosphonium, sulfonium, chloronium, bromonium, and iodonium, wherein said cation of said salt contains an aromatic moiety ring-substituted with at least one electrowithdrawing moiety and has at least one replaceable nuclear hydrogen, and wherein the anion of said salt is an anion of said strong carboxylic acid, said acid having a $pK_a(H_2O)$ at 25° C. value of less than about 3, to effect nuclear hydroxylation of said aromatic moiety wherein a hydroxy group replaces said hydrogen.

* * * * *